United States Patent [19]

Judice

[11] 4,411,431

[45] Oct. 25, 1983

[54] GOLF PUTTING PRACTICE DEVICE

[75] Inventor: Clay Judice, Lafayette, La.

[73] Assignee: Strokee Enterprises, Lafayette, La.

[21] Appl. No.: 372,301

[22] Filed: Apr. 27, 1982

[51] Int. Cl.[3] ..... A63B 69/36

[52] U.S. Cl. ..... 273/183 C; 273/58 K

[58] Field of Search ..... 273/183 C, 185 R, 185 D, 273/199 R, 58 K, 199 A, 200 R, 200 A, 200 B, 58 C

[56] References Cited

U.S. PATENT DOCUMENTS

| | | | |
|---|---|---|---|
| 2,484,397 | 10/1949 | Barton | 273/199 R |
| 3,165,930 | 1/1965 | Halpern et al. | 273/183 C X |
| 3,357,705 | 12/1967 | Blanchard | 273/199 R |
| 3,427,030 | 2/1969 | Ward | 273/199 R X |
| 3,788,646 | 1/1974 | Rawson | 273/183 C |
| 3,918,720 | 11/1975 | Gordos | 273/183 C |
| 4,209,172 | 6/1980 | Yamamoto | 273/183 C |

*Primary Examiner*—George J. Marlo

*Attorney, Agent, or Firm*—LeBlanc, Nolan, Shur & Nies

[57] ABSTRACT

A device which allows a golfer to practice the putting stroke. The device includes a pair of ball members connected in spaced relationship by a rod member. Each of the ball members is of the size of a standard golf ball and the total weight of the device is approximately that of a standard golf ball. In use, the putting device is first aligned on the putting surface between the putter and the intended target so that the rod member is aligned along the line between the putter and the target, and the golfer then contacts the ball at the outer end of the device with the putter moving in the direction of the rod member so that the device travels toward the target. The device allows the golfer to verify putter face alignment during address of the ball and also to establish whether or not a correct putting stroke has been executed through the zone in which the putter makes contact with the ball.

12 Claims, 7 Drawing Figures

GOLF PUTTING PRACTICE DEVICE

BACKGROUND OF THE INVENTION

The present invention relates to a putting device for use by an individual golfer. More particularly, the present invention relates to a putting aid or device which allows an individual golfer both to verify putter face alignment upon addressing the ball and also to establish whether or not a correct putting stroke has been executed through the zone in which the putter face makes contact with the ball.

Various golf putting devices are described in the prior art, including those described in the following U.S. patents: U.S. Pat. Nos. 1,611,076 to Rittner; 2,002,631 to Fiondella; U.S. Pat. Nos. 3,165,930 to Halpern et al; 3,357,705 to Blanchard; and U.S. Pat. No. 3,918,720 to Gordos.

The Gordos patent illustrates a putting device in which there are two simulated balls attached to the end of a short rigid rod. The two balls are each the same size and weight as a standard golf ball and formed of a solid rubber material. The rod interconnecting the balls must be extremely short since, in using the putting device, the head of the putter must be able to contact both balls. In use, the two balls with the interconnecting rod are arranged so that the putter when properly used will simultaneously hit both balls. If the putter does not properly contact both balls simultaneously, then the balls will move at an angle such as shown in FIGS. 3 and 4 of the patent.

The Blanchard patent illustrates a golf practicing device which is usable with various types of irons of a golf set. In the use of the Blanchard device, in which two golf balls, preferably of standard size and weight, are interconnected by a flexible member, the device is hit by the use of one of the irons so as to travel through the air. The device shown in this patent is used for enabling the golfer to practice his swing, with the ball once hit only traveling a very short distance.

In the Halpern et al patent, there is illustrated a device for use in a golf type game in which two balls are interconnected by a rope. The Fiondella patent describes a game using a device having two balls interconnected by a relatively stiff rubber tubing member. These balls are hit by striking the tubing itself instead of the balls. The Rittner patent illustrates two balls which are connected together by a rope, although both balls act independently.

SUMMARY OF THE INVENTION

By the present invention there is provided a golf putting aid or device which allows a golfer to practice his putting stroke and, in particular, both to verify putter face alignment during address of the ball and also to establish whether or not a correct putting stroke is executed through the zone in which the putter makes contact with the ball.

The golf putting device of the present invention is an integral unit which is formed with two golf balls interconnected by a rigid rod so that the entire structure is rigid with no relative movement between components. Both balls should be of the size of a standard golf ball and of a weight such that the total weight of the device is approximately equal to the weight of a conventional or standard golf ball. Thus, in one embodiment each ball has a weight equal to approximately one-half the weight of a standard golf ball. In another embodiment, one ball has the approximate weight of a standard golf ball while the other ball is of a lightweight plastic material. At least one of the balls, i.e., the ball to be contacted by the putter, should have the compression characteristics of a standard golf ball. The rod that interconnects the balls should be a lightweight rigid rod of approximately 6 to 10 inches in length.

In the use of the golf putting device of the present invention, the two balls with the interconnected rod are aligned so as to be in a straight line between the putter and the target. In this manner, the golfer will hit the standard compression golf ball with the putter and, if the putting device is hit properly, both balls with the rod will travel in a straight line towards the target. If, however, the standard ball is not stroked properly with the putter, then the balls will veer off in one direction or the other from the target, depending upon the nature of the particular error in the putting stroke.

Accordingly, it is an object of the present invention to provide a gold putting device which allows an individual golfer, without additional assistance, both to verify putter face alignment at address of the ball and also to establish whether or not a correct putting stroke was executed through the zone of contact with the ball.

It is another object of the invention to provide a golf putting device of relatively simple construction which allows an individual golfer to practice his putting stroke without additional equipment other than the device itself.

It is a further object of the invention to provide a golf putting device, the components of which may be varied to increase or decrease the difficulty of achieving the desired result.

It is a further object of the invention to provide a golf putting device which allows the golfer to practice his putting stroke such that correct practice with the device will instill both "muscle memory" and confidence in the golfer.

A still further object of the invention is to provide a golf putting device, the construction and operation of which forces the golfer to accelerate the putter head through the ball in the contact zone and in so doing encourages the development of a firm putting stroke.

DESCRIPTION OF THE PREFERRED EMBODIMENTS

Figure 1:
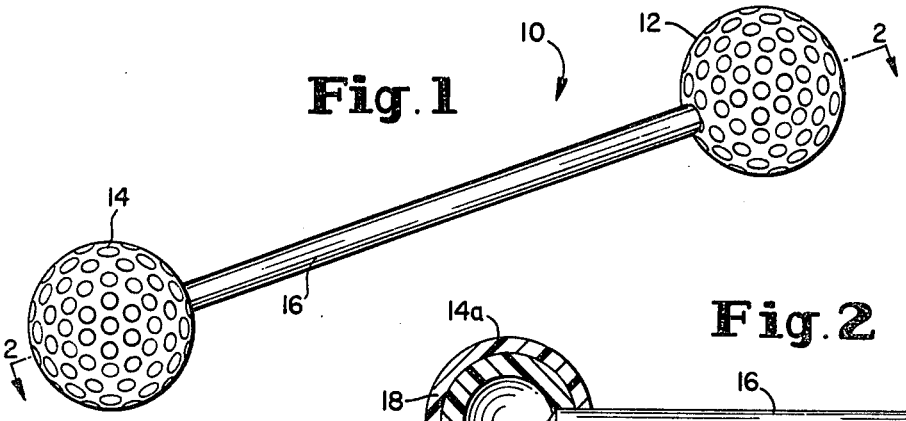
FIG. 1 is a perspective view of the golf putting device of the present invention.
Figure 2:
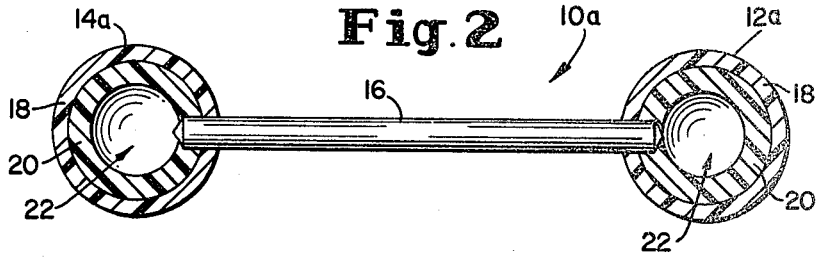
FIG. 2 is a cross-sectional view taken along line 2—2 of FIG. 1, showing a first embodiment of the golf putting device of the present invention.
Figure 3:
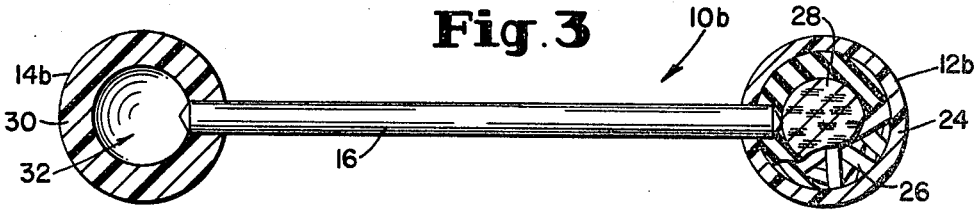
FIG. 3 is a cross-sectional view similar to FIG. 2, showing a second embodiment of the golf putting device of the present invention.

In the embodiments of the present invention as illustrated in FIGS. 1–3, there is provided a golf putting device 10 including two spherical-shaped ball members 12 and 14 interconnected by a rigid rod member 16, with the diameter of the rod 16 being less than the diameter of the balls 12, 14. As shown in FIGS. 2 and 3, the balls 12 and 14 are drilled so as to equally receive the rod 16 which is aligned between the respective centers of the balls 12 and 14. The rod 16, having a length such as about 6 to 10 inches between balls, 12, 14, is rigidly attached to the balls 12 and 14 by means such as a suitable adhesive. The rod 16 may be formed from any suitable material such as a lightweight plastic.

In order that the putting device 10 of the present invention will simulate characteristics of a standard golf ball, it is preferable that both balls 12, 14 be of a size of a standard golf ball and that the total weight of the device 10 should approximately equal the weight of a standard golf ball. It is also preferable that at least one of the balls 12, 14, i.e., the ball to be contacted by the putter head, have the compression characteristics of a standard golf ball. Thus, in the embodiment shown in FIG. 2, the device 10*a* includes balls 12*a*, 14*a*, which are of equal weight, approximately one-half that of a conventional golf ball. Such a weight may be obtained, for example, by constructing the balls 12*a*, 14*a* with a plastic outer cover 18 over a core member 20 of a resilient material such as rubber, with core member 20 having a hollow center portion 22. As previously stated, at least one of the balls 12*a*, 14*a*, should be constructed so that the outer cover 18 has the compression characteristics of a standard golf ball.

In the embodiment shown in FIG. 3, the device 10*b* includes ball 12*b* which has substantially the weight of a standard golf ball, being formed, for example, of a plastic outer sheath 24 over a layer 26 of strips of a resilient material such as rubber which are wound over a center 28 of a material such as cork, in accordance with standard golf ball construction techniques. The ball 14*b* is of lightweight construction, including an outer cover 30 of lightweight plastic material with hollow center portion 32. The rod 16 and ball 14*b* in the embodiment of FIG. 3 should be of sufficiently lightweight construction that the overall weight of the device 10*b* is approximately that of a standard golf ball.

The embodiments of FIGS. 2 and 3 provide variations in the skill and precision required to stroke the putting aid 10 in the proper manner. Thus the embodiment of FIG. 2, with two balls of approximately equal weight, would present a lesser degree of difficulty and this embodiment of the invention would be better suited for practicing longer putts. The device 10*b* of FIG. 3 on the other hand, with one ball 12*b* of standard weight and the other ball 14*b* of a lightweight material, would require a more accurate stroke and be better suited for practicing short putts.

A variation in the length of the connecting rod 16 will also change the skill level, with a shorter rod, being more difficult to align properly, thus requiring a more precise stroke than a longer rod in order to hit the target.

Figure 4:
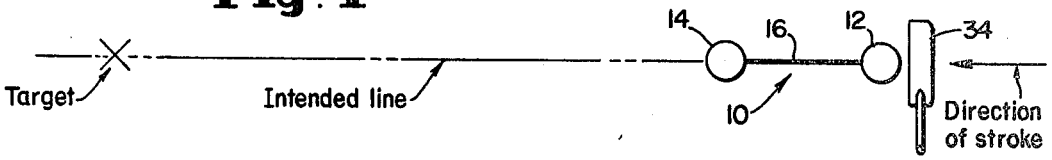
FIG. 4 illustrates the proper position of the golf putting device of FIG. 1, in alignment between the target and the putter head, prior to contact by the putter.

In the use of the putting device 10 of the present invention, the device 10 is placed on a suitable putting surface such as a putting green, rug, or other suitable surface. The golfer takes a position behind the device and, through visual observation, aligns the rod 16 along the line between the face of the putter 34 and the target. The golfer then assumes a putting stance with the putter face positioned at a right angle to the rod 16 directly behind the ball 12, which is on the opposite side of the rod 16 from the target, as shown in FIG. 4. By looking back and forth from the putter face to the target, the golfer can create a "mental picture" of the correct right angle alignment for the face of the putter 34.

Figure 5:
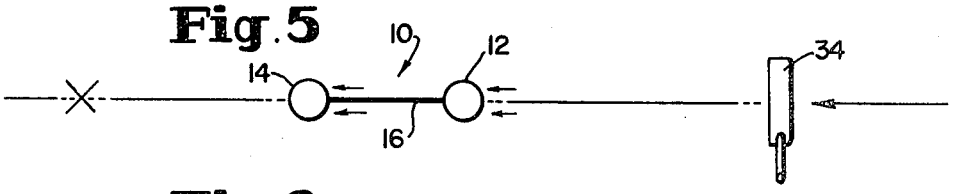
FIGS. 5–7 illustrate various possible paths of advance of the golf putting device of the present invention upon being struck by the putter head.

After aligning the device 10 and the face of the putter 34 as described above, the golfer strokes the ball 12 towards the target with the correct line being indicated by the connecting rod 16. If a proper stroke is made, the result will be a movement of both balls 12, 14 along the desired line of movement towards the target, as shown in FIG. 5.

Figure 6:
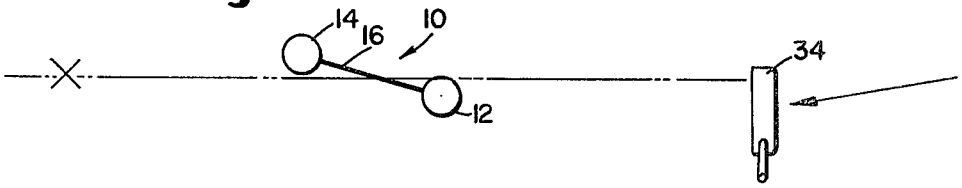
Figure 7:
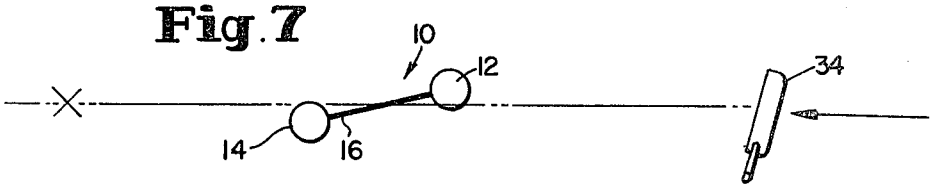

An incorrect stroke will result in balls 12 and 14 sliding along different paths with the connecting rod 16 losing its original orientation. Thus, for example, as shown in FIG. 6, if the direction of the putting stroke is not along the intended line of movement toward the target, the device 10 will slide off the intended path even though the face of the putter 34 is in proper alignment at a right angle to the intended line. As shown in FIG. 7, an incorrect result will also be obtained when the putter face is not aligned at the proper angle, even though the direction of the putting stroke is correct. Thus, for a stroke to be proven correct by the putting device 10, the stroke must be executed along the intended line toward the target and at the same time, the face of the putter must be properly positioned at a right angle to the intended line at the time the putter makes contact with the ball 12.

In the use of the device 10, the movement of ball 12 with respect to ball 14 will indicate not only the direction of an errant stroke but also the degree of inaccuracy. An additional advantage of the invention is that the device 10 does not roll but instead slides after being struck. This sliding action forces the golfer to accelerate the putter head through the ball and thus encourages the development of a firm putting stroke. It has been found that correct practice with the putting device 10 of the present invention serves to instill both "muscle memory" and confidence in the golfer.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A golf putting device, comprising: a pair of spherical-shaped ball members connected in spaced relationship by a rigid rod member which is aligned between the centers of said ball members, said rigid rod providing for no relative movement between components during a conventional putting stroke, each of said ball members being approximately the size of a standard golf ball; said rod member being of a length of 6 to 10 inches so as to be of sufficient length to allow the rod to serve as a means of alignment of the device between a golf putter and an intended target; at least one of the ball members having the compression characteristics of a standard golf ball; and with the total weight of the device being approximately equal to the weight of a standard golf ball.

2. The golf putting device of claim 1 wherein each of the ball members has a weight equal to approximately one-half the weight of a standard golf ball.

3. The golf putting device of claim 1 wherein one of the ball members has a weight approximately equal to that of a standard golf ball and the other ball member is formed of a lightweight plastic material.

4. A method of practicing golf by the use of a golf putting device which is stroked by a putter towards an intended target, which comprises:

a. aligning a golf putting device on a putting surface between the putter and the target, said putting device including a pair of spherical-shaped ball members connected in spaced relationship by an elongated straight rod member, so that said rod member is aligned along the line between the putter and the target; and b. contacting said putting device with the putter moving in the direction of said rod member so that said putting device travels toward the target.

5. The method of claim 4 wherein the total weight of the putting device is approximately equal to the weight of a standard golf ball.

6. The method of claim 4 wherein each of said ball members is approximately the size of a standard golf ball and wherein at least one of the ball members has the compression characteristics of a standard golf ball.

7. The method of claim 6 wherein the putter contacts the ball member located on the opposite side of the rod member from the target, said contacted ball member having the compression characteristics of a standard golf ball.

8. The method of claim 7 wherein said ball member which is contacted by the putter has a weight approximately equal to that of a standard golf ball.

9. The method of claim 4 wherein each of the ball members has a weight equal to approximately one-half the weight of a standard golf ball.

10. The method of claim 4 wherein one of the ball members has a weight approximately equal to that of a standard golf ball and the other ball member is formed of a lightweight plastic material.

11. The method of claim 4 wherein said rod member has a length of approximately 6 to 10 inches.

12. The method of claim 4 wherein said putting device travels along said putting surface as it travels toward the target.

* * * * *